United States Patent [19]

Gobush

[11] Patent Number: 4,772,026

[45] Date of Patent: Sep. 20, 1988

[54] GOLF BALL

[75] Inventor: William Gobush, North Dartmouth, Mass.

[73] Assignee: Acushnet Company, New Bedford, Mass.

[21] Appl. No.: 58,141

[22] Filed: Jun. 4, 1987

[51] Int. Cl.[4] ..... A63B 37/14

[52] U.S. Cl. ..... 273/232; 273/183 C

[58] Field of Search ..... 273/232, 233, 213, 62, 273/183 C; 40/327

[56] References Cited

U.S. PATENT DOCUMENTS 4,560,168 12/1985 Aoyama ..... 273/232

FOREIGN PATENT DOCUMENTS 377354 7/1932 United Kingdom ..... 273/232

*Primary Examiner*—George J. Marlo

*Attorney, Agent, or Firm*—Lucas & Just

[57] ABSTRACT

A golf ball having dimples covering its surface and having six great circular paths on the surface of the golf ball where none of the paths intersect a dimple is disclosed. The six great circular paths are obtained by inscribing a cubical pattern in the surface of the golf ball, dividing each square face of the cube into four isosceles triangles by bisecting the square face twice and filling each triangle so produced with dimples. A total of twenty-four triangles are obtained on the surface of the golf ball. Golf balls having six great circles and having 360, 384, 408, and 432 dimples are disclosed.

20 Claims, 10 Drawing Sheets

GOLF BALL

The present invention relates to golf balls and, more particularly, to golf balls having six parting lines and dimples evenly and uniformly distributed over the surface of the ball such that the dimple pattern on one side of a parting line is a mirror image of the dimple pattern on the other side of the parting line.

Typically, golf balls are made in a molding process that imparts a single mold parting line on the ball. Attempts have been made to increase the number of parting lines on a golf ball by adding so-called false parting lines. However, such attempts have produced large bald spots or parting lines that intersect the dimples. Both of these outcomes are undesirable. A recent attempt, U.S. Pat. No. 4,560,168, describes a golf ball with six parting lines and dimple patterns which do not form mirror images along the parting lines. In the '168 patent, the dimples are arranged on the surface of a golf ball by first dividing the spherical surface of the golf ball into twenty triangles corresponding to a regular icosahedron, and then subdividing each triangle so formed into four smaller triangles. Those smaller triangles are formed by joining the midpoints of each of the icosahedron triangles. The parting lines are coextensive with the lines that join the midpoints. Such a pattern produces an uneven or non-mirror image dimple pattern along any given parting line, as is clearly evident from the description and drawings of the '168 patent.

Generally, golfers prefer a mirror image dimple pattern along the parting line because they often use the parting line to align their shots, and a mirror image dimple pattern along the parting line provides a visual balance. A non-mirror image dimple pattern along the parting line provides a visual unevenness and can ruin the golfer's shot. The present invention overcomes these disadvantages as well as others.

The present invention provides a golf ball with six parting lines which correspond to six great circular paths that encircle the golf ball, where none of the parting lines intersect any of the dimples, and where the dimple pattern on one side of a parting line is a mirror image of the dimple pattern on the other side of the parting line.

The dimple pattern of the present invention is obtained by dividing the spherical surface of the golf ball into twenty-four spherical, substantially identical isosceles triangles. The isosceles triangles are located on the surface of the golf ball by first inscribing a cube inside the spherical surface, and then quartering each square face of the cube into four isosceles triangles. The isosceles triangles are formed by bisecting the square faces of the cube twice on the diagonal, i.e. connecting opposite corners of the square. These twenty-four isosceles triangles are then inscribed on the surface of the golf ball. The lines, which bisect the faces of the cube, form six great circular paths having the diameter of the golf ball. These six great circular paths correspond to the positions of the parting lines on the surface of the golf ball. The parting lines are coextensive with the six great circular paths. Preferably, the mold parting line corresponds to one of the parting lines of the present invention, while the other five are false parting lines.

Dimples are evenly and uniformly distributed over the surface of the golf ball by arranging dimples inside of each of the twenty-four isosceles triangles, making sure that none of the dimples intersect any of the great circular paths. The dimples may be of any size, shape, and number to include patterns with multiple diameter dimples. Preferably, at least about 50% of the surface of the golf ball is covered with dimples.

Preferably, dimple patterns having a total of 360, 384, 408, or 432 dimples are used. Some manufacturers remove a small number of dimples, typically about eight, four at each pole, so that a trademark and identification number can be affixed to the ball. However, modern stamping methods allow for affixing trademarks and identification numbers without the removal of dimples.

In order to obtain a substantial mirror image dimple pattern along each of the parting lines, the dimple pattern in each of the twenty-four isosceles triangles is substantially identical.

These and other aspects of the present invention may be more fully understood with reference to the accompanying drawings where:

Figure 1:
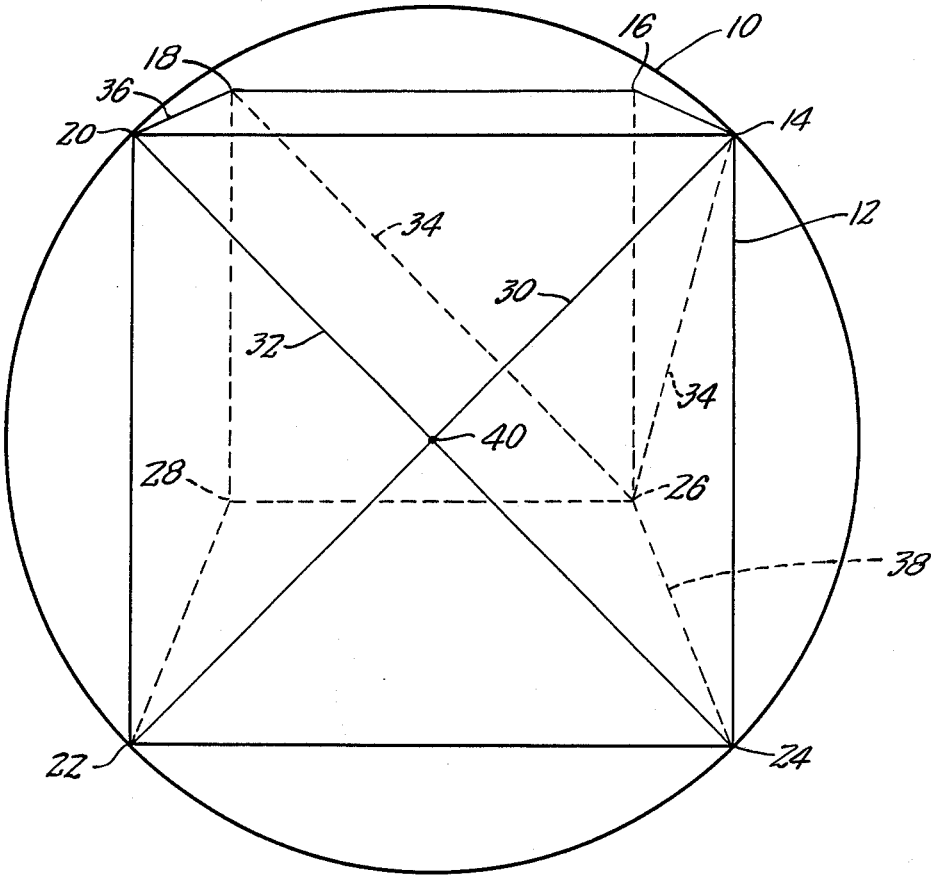
FIG. 1 illustrates a cube inscribed in a sphere in accordance with the present invention.

FIG. 1 illustrates sphere 10, inside of which cube 12 is inserted. The eight corners of cube 12 are numbered 14, 16, 18, 20, 22, 24, 26, and 28 as illustrated. The face of the cube, bounded by the four corners 14, 20, 22, and 24, is bisected twice by bisecting lines 30 and 32, and cube face bounded by corners 16, 18, 28, and 26, is bisected once by line 34. Line 36 is a common edge shared by the cube face bounded by corners 14, 16, 18, and 20, and cube face bounded by corners 18, 20, 22 and 28. Line 38 is a common edge between cube face bounded by corners 14, 16, 26, 24 and cube face bounded by corners 22, 24, 26, and 28. A great circular path is illustrated by the lines marked 32, 36, 34, and 38.

An alternative way to identify great circular paths using FIG. 1 herein is to designate corners of the cube that intersect the great circular path. For example, the great circular path marked by lines 32-36-34-38 is also marked by corners 24-20-18-26. The remaining five great circular paths are identified by the following sets of four corners: 14-24-28-18; 16-20-22-26; 14-16-28-22; 14-20-28-26; and 16-18-22-24. Each great circular path picks up four corners of the cube, one bisecting line on two different faces of the cube, and two common edges shared by two pairs of square faces. It will be appreciated that three great circular paths pass through each corner of the cube.

One isosceles triangle on the cube face bounded by corners 14-20-22-24 is defined by corners 22-24 and vertex 40. Vertex 40 is the intersection between the two bisecting lines 30 and 32. Each of the four isosceles triangles of cube face 14-20-22-24 are substantially identical. The four isosceles triangles on cube face 14-20-22-24 are identified by the three points, 40-22-24, 40-22-20, 40-20-14, and 40-14-24.

Figure 2:
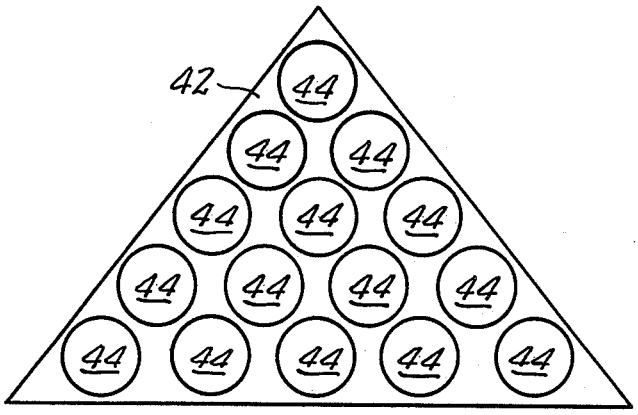
FIGS. 2–8 illustrate isosceles triangles having various dimple patterns in accordance with the present invention; and, FIGS. 9–15 illustrate projected surfaces of various golf balls having various dimple patterns on their surfaces made in accordance with the present invention.
Figure 3:
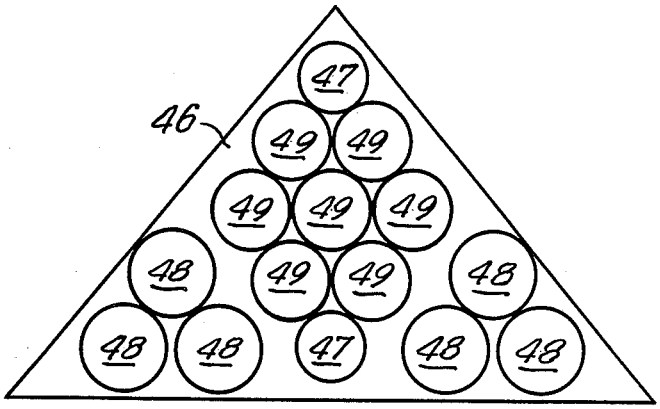
Figure 4:
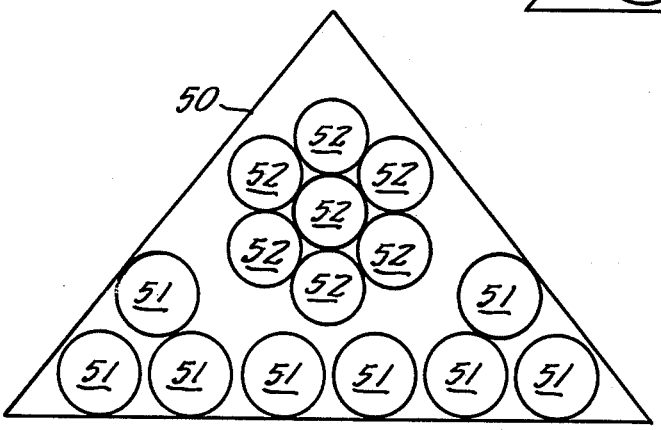

FIGS. 2–4 are preferred dimple patterns for a golf ball having 360 dimples.

FIG. 2 illustrates one preferred pattern of dimples for isosceles triangle 42 having dimples 44 positioned therein. Using such a pattern of dimples over the whole surface of the ball produces a pattern of 360 dimples. Dimples 44 have a maximum diameter of about 0.145 inches.

FIG. 3 illustrates another preferred pattern of dimples in isosceles triangle 46 with dimples 47, 48 and 49. Dimples 47 have a maximum diameter of about 0.130 inches, dimples 48 have a maximum diameter of about 0.145 inches and dimples 49 have a maximum diameter of about 0.140 inches. This pattern provides for a golf ball with 360 dimples.

FIG. 4 illustrates yet another preferred embodiment of the present invention. Inside isosceles triangle 50, dimples 51 and 52 are arranged. Dimple 51 has a maximum diameter of about 0.146 inches while dimple 52 has a maximum diameter of about 0.136 inches. The dimple pattern of isosceles triangle 50 produces a golf ball having 360 dimples.

Figure 5:
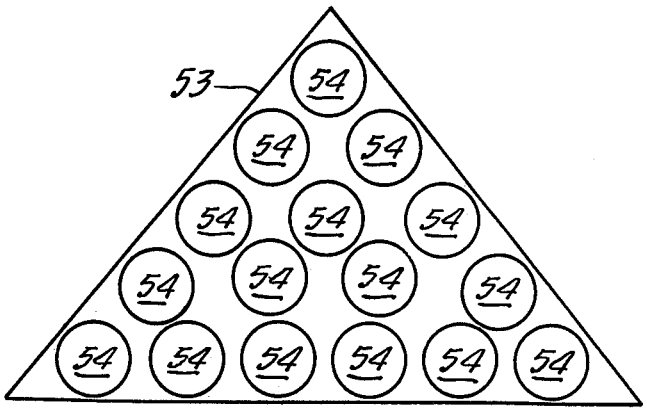

FIG. 5 illustrates a preferred embodiment of the present invention for producing a golf ball with 384 dimples. In FIG. 5 isosceles triangle 53 has dimples 54. Dimples 54 have a maximum diameter of about 0.143 inches.

Figure 6:
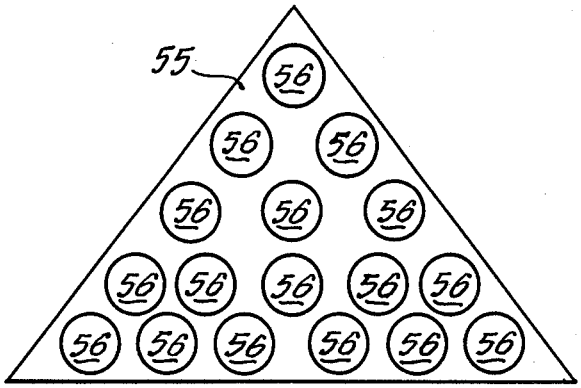

FIG. 6 illustrates a preferred embodiment of the present invention for producing a golf ball with 408 dimples. In FIG. 6 isosceles triangle 55 has dimples 56. Dimples 56 have a maximum diameter of about 0.139 inches.

Figure 7:
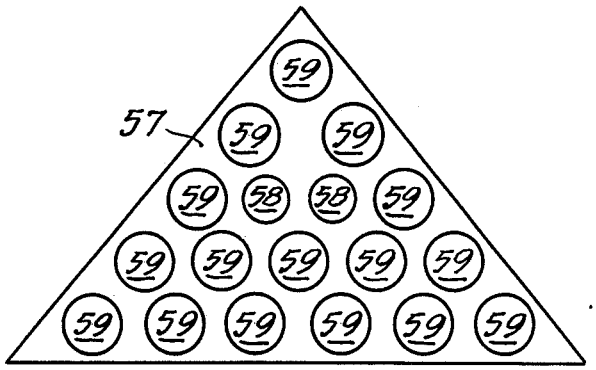

FIG. 7 illustrates a preferred embodiment of the present invention for producing a golf ball with 432 dimples. In FIG. 7 isosceles triangle 57 has dimples 58 and 59. Dimples 58 have a maximum diameter of about 0.125 inches and dimples 59 have a maximum diameter of about 0.139 inches.

Figure 8:
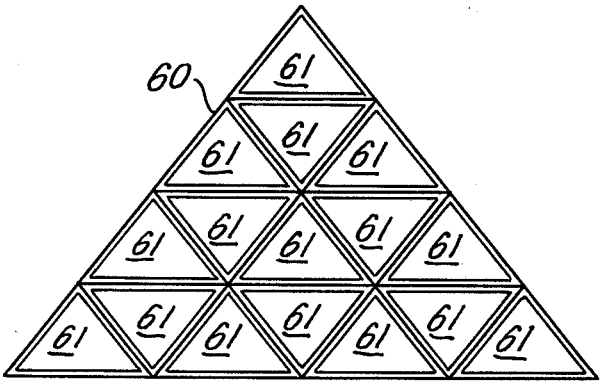

FIG. 8 illustrates a preferred embodiment of the present invention for producing a golf ball with 384 triangular dimples. In FIG. 8 isosceles triangle 60 has triangular dimples 61. Typically, triangular dimples 61 measure about 0.19 inches by about 0.21 inches by about 0.24 and are about 0.013 inches deep.

Figure 9:
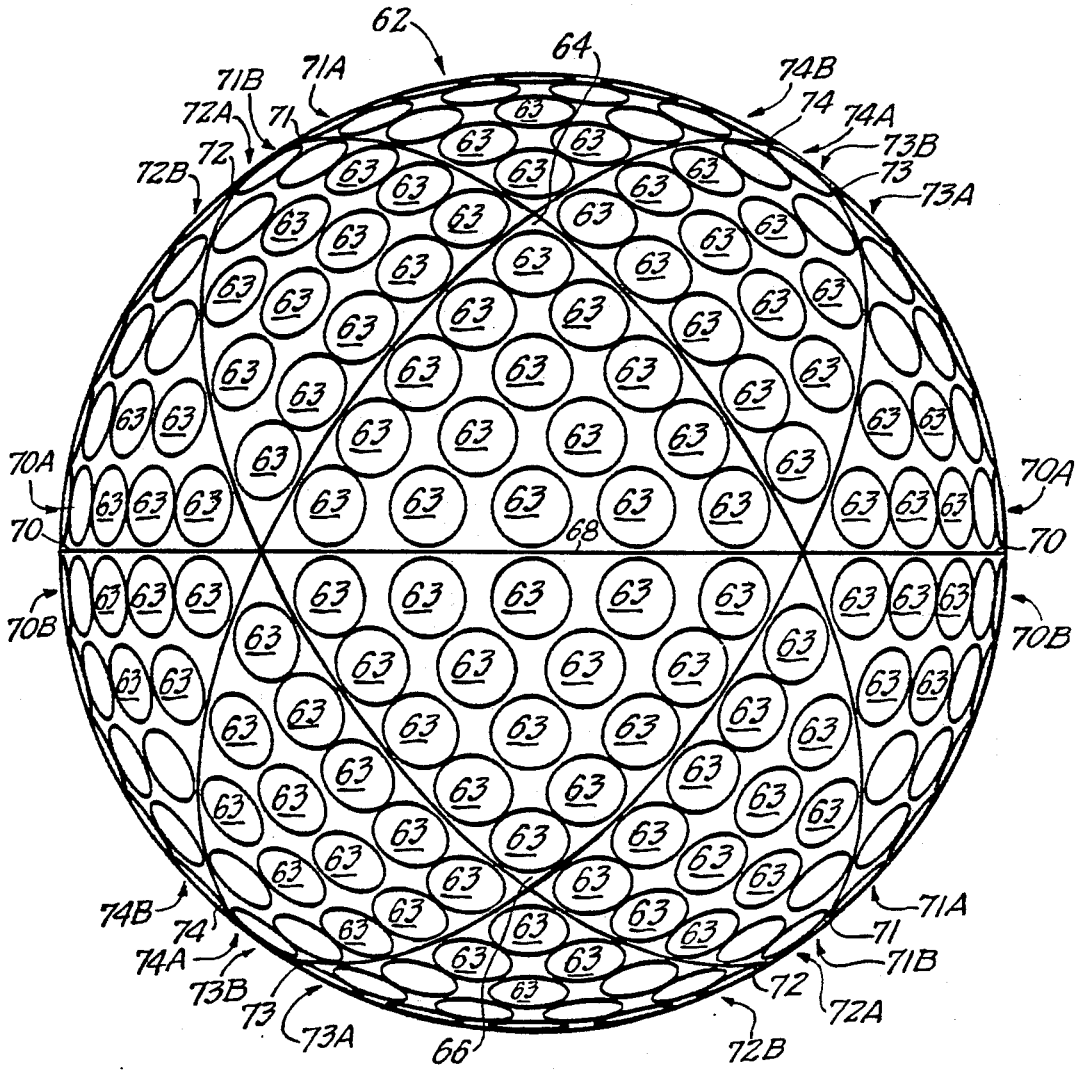

FIG. 9 is a projected surface of golf ball 62 made in accordance with the present invention having the dimple pattern of FIG. 2 laid thereon. Dimples 63 of golf ball 62 measure about 0.145 inches in diameter. Such a golf ball has 360 dimples thereon. Two isosceles triangles are shown, 64 and 66, with common edge 68. Common edge 68 makes up a section of great circular path 70. The mirror image dimple pattern of the present invention can be seen along section 68 of great circular path 70. Dimples in row 70A substantially mirror dimples in row 70B to produce a substantial mirror image dimple pattern along section 68 of great circular path 70. This mirror image dimple pattern is along the entire length of great circular path 70. Four other great circular paths are shown, 71, 72, 73 and 74. The mirror image dimple pattern of the present invention is apparent by comparing rows 71A, 72A, 73A and 74A with rows 71B, 72B, 73B, 74B, respectively.

It is also readily apparent that the dimple pattern in triangle 64 is a substantial mirror image of the dimple pattern in triangle 66. Such a mirror image exists along each of the great circular paths.

Figure 10:
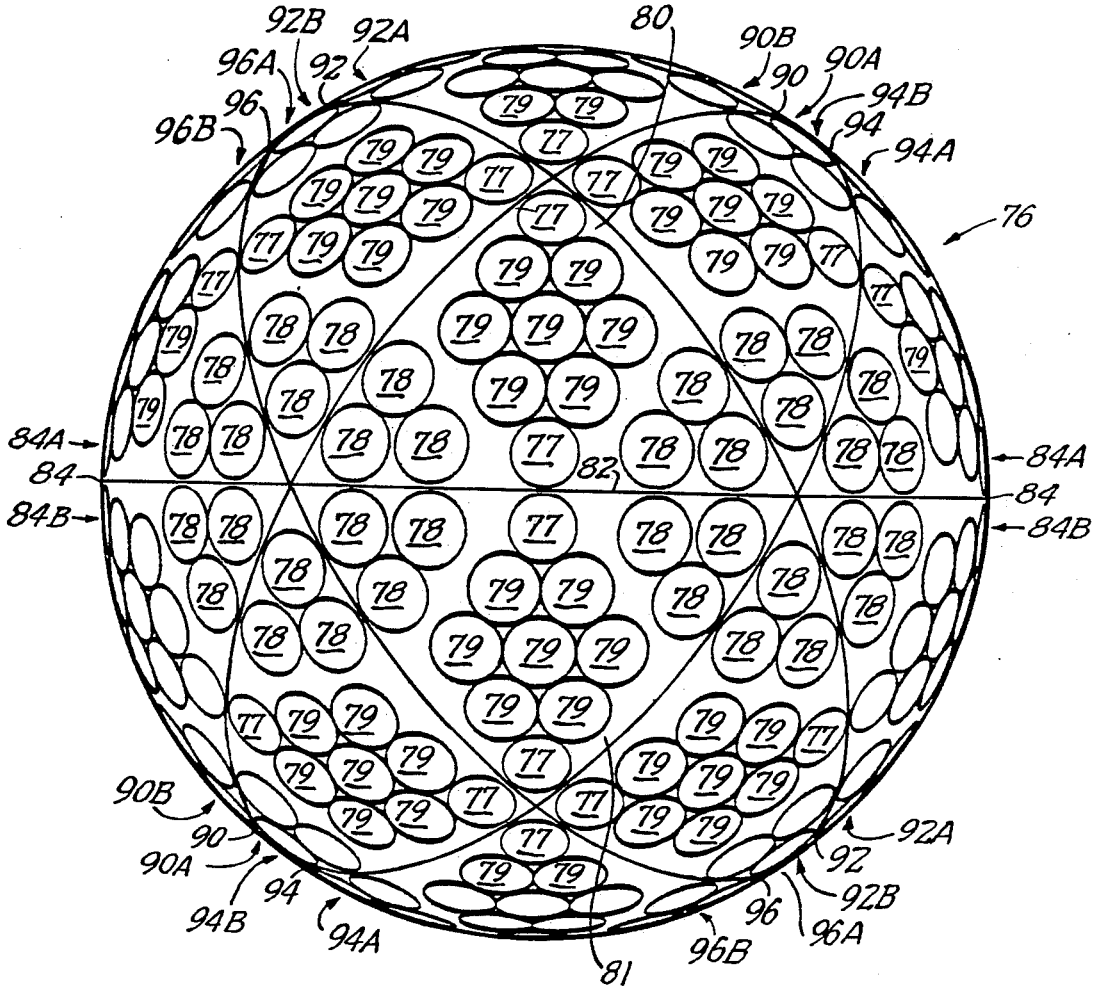

FIG. 10 is a projected surface of a golf ball 76 made in accordance with the present invention having the dimple pattern of FIG. 3 laid thereon. Dimples 77 measure about 0.13 inches in diameter, dimples 78 measure about 0.145 inches in diameter and dimples 79 measure about 0.140 inches in diameter. Such a golf ball has 360 dimples thereon. Two isosceles triangles are shown, 80 and 81. Isosceles triangles 80 and 81 share common edge 82. Common edge 82 forms part of great circular path 84. The mirror image dimple pattern of the present invention is evident along common edge 82 where dimples in row 84A substantially mirror dimples in row 84B. In FIG. 10, four other great circles are shown and are number 90, 92, 94, and 96. The mirror image dimple pattern of the present invention is clearly evident along great circular paths 84, 90, 92, 94 and 96 by comparing dimples in rows 84A, 90A, 92A, 94A and 96A with dimples in rows 84B, 90B, 92B, 94B and 96B, respectively.

It is also readily apparent that the dimple pattern in triangle 80 is a substantial mirror image of the dimple pattern in triangle 81. Such a mirror image exists along each of the great circular paths.

Figure 11:
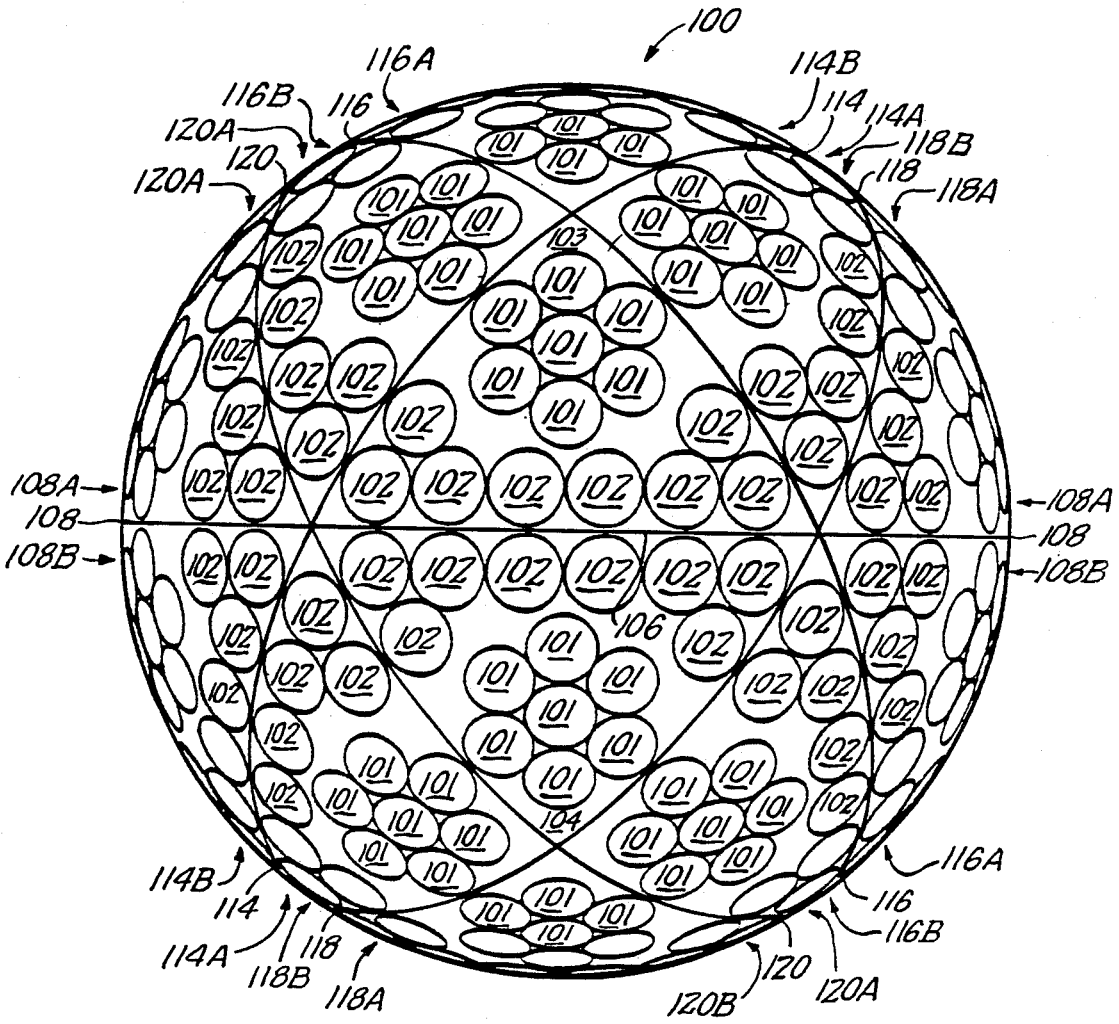

FIG. 11 is a projected surface of golf ball 100 made in accordance with the present invention having the dimple pattern of FIG. 4 laid thereon. Dimples 101 have a dimple diameter of about 0.136 inches, and dimples 102 have a dimple diameter of about 0.146 inches. Such a golf ball has 360 dimples thereon. Two isosceles triangles are shown, 103 and 104, with common edge 106. Common edge 106 makes up a portion of great circular path 108. The mirror image dimple pattern of the present invention is evident along section 106 of great circular path 108. Dimples in row 108A substantially mirror dimples in row 108B. Great circular paths are designated by the lines 114, 116, 118, and 120. The mirror image in dimple pattern of the present invention is seen by comparing the dimples in rows 114A, 116A, 118A and 120A with the dimples in rows 114B, 116B, 118B and 120B.

It is also readily apparent that the dimple pattern in triangle 103 is a substantial mirror image of the dimple pattern in triangle 104. Such a mirror image exists along each of the great circular paths.

Figure 12:
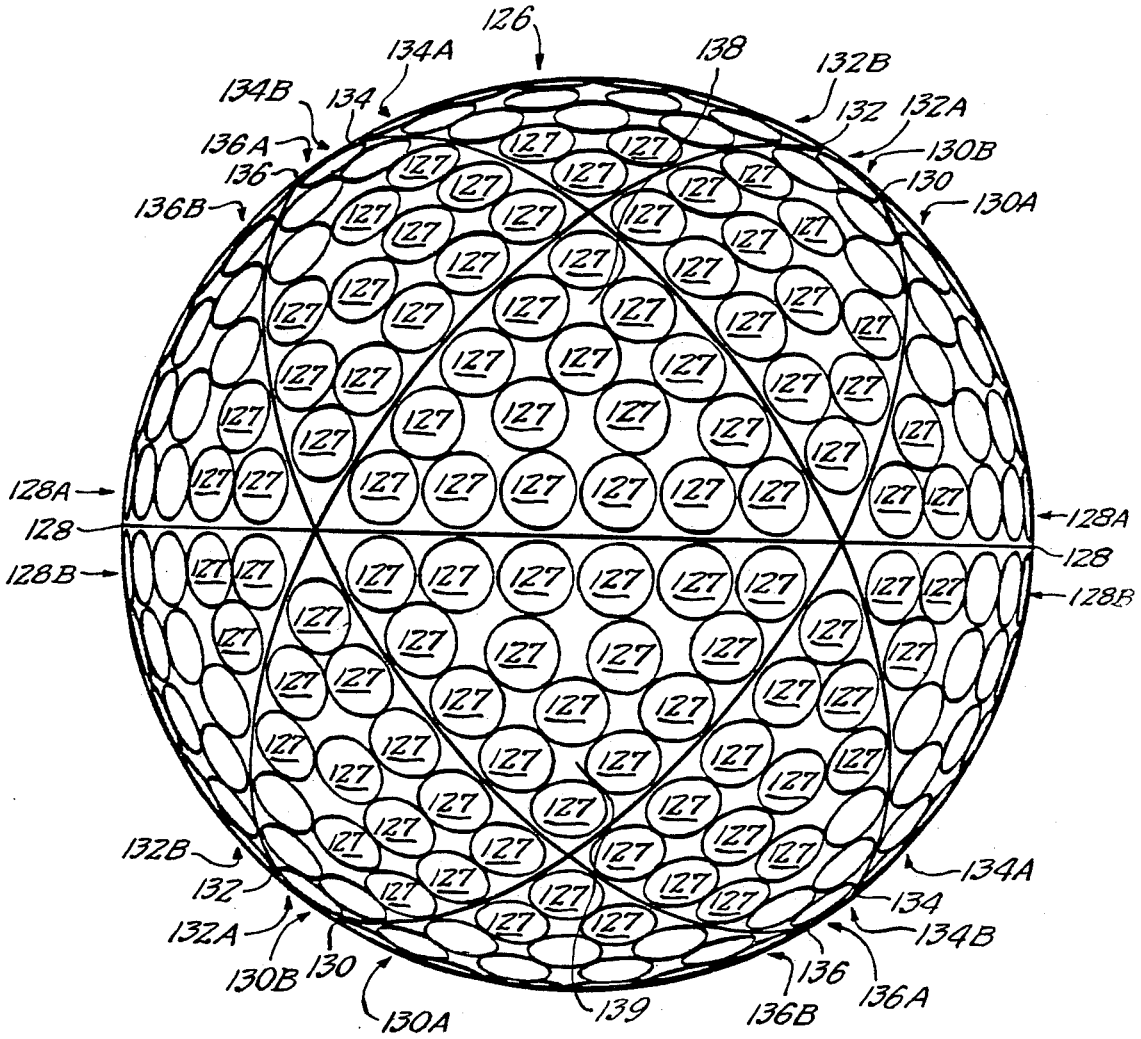

FIG. 12 is a projected view of golf ball 126 made in accordance with the present invention having the dimple pattern of FIG. 5 laid thereon. Dimples 127 have a dimple diameter of about 0.143 inches. Such a golf ball has 384 dimples thereon. Five great circular paths are labeled 128, 130, 132, 134, and 136. The mirror image dimple pattern of the present invention is clearly evident along each great circular path. Specifically, for the mirror image of the dimple pattern of the present invention, compare the dimple pattern in rows 128A, 130A, 132A, 134A and 136A with those in rows 128B, 130B, 132B, 134B and 136B, respectively.

It is also readily apparent that the dimple pattern in triangle 138 is a mirror image of the dimple pattern in triangle 139. Such a mirror image exists along each of the great circular paths.

Figure 13:
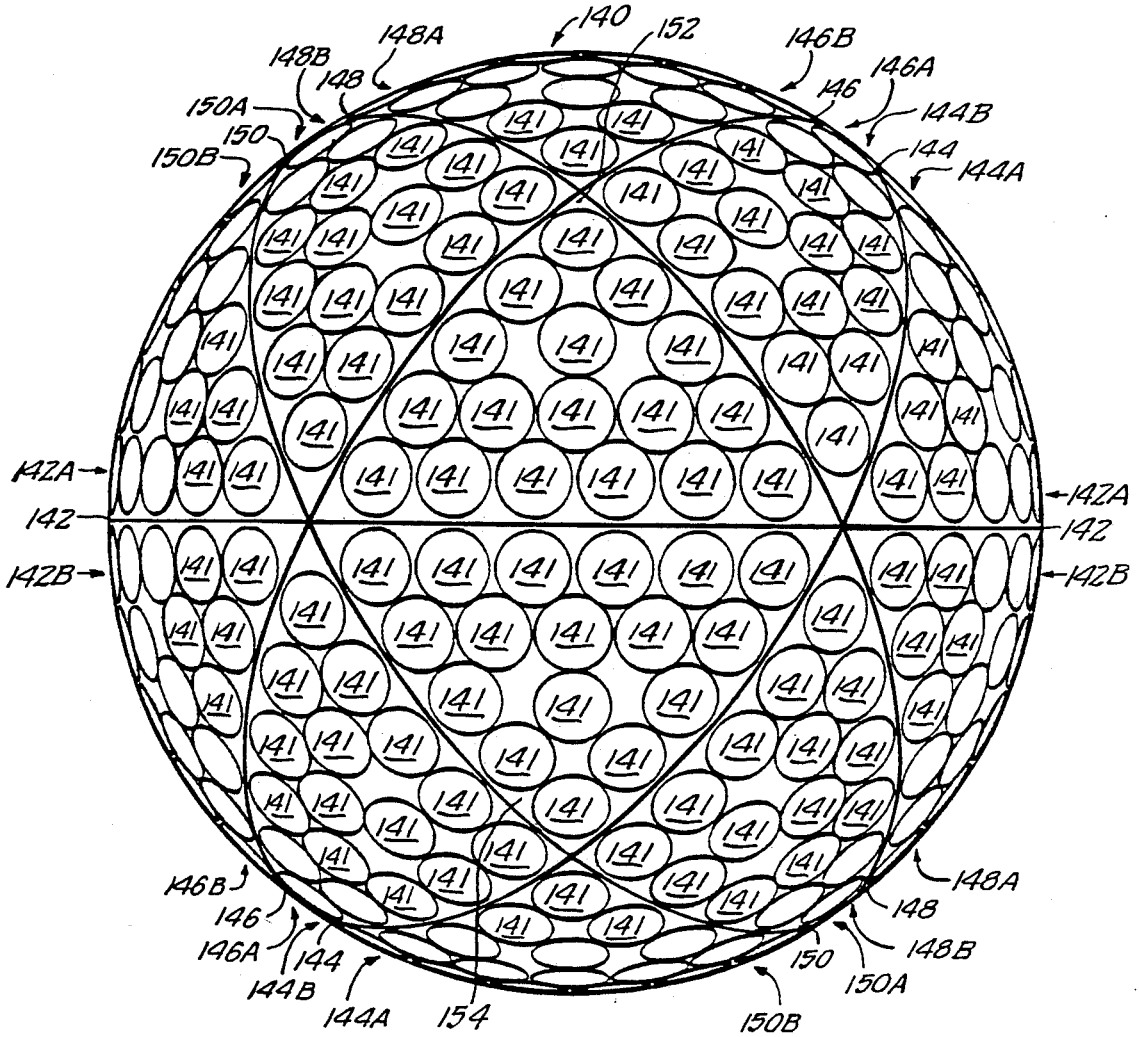

FIG. 13 is a projected view of golf ball 140 made in accordance with the present invention having the dimple pattern of FIG. 6 laid thereon. Dimples 141 have a diameter of about 0.139 inches. Such a golf ball has 408 dimples thereon. Five great circular paths are illustrated, 142, 144, 146, 148, and 150. Dimples in isosceles triangle 152 substantially mirror dimples 153 in isosceles triangle 154. The mirror image dimple pattern of the present invention is evident by comparing the dimples in rows 142A, 144A, 146A, 148A and 150A with those in rows 142B, 144B, 146B, 148B and 150B, respectively.

It is also readily apparent that the dimple pattern in triangle 152 is a substantial mirror image of the dimple pattern in triangle 154. Such a mirror image exists along each of the great circular paths.

Figure 14:
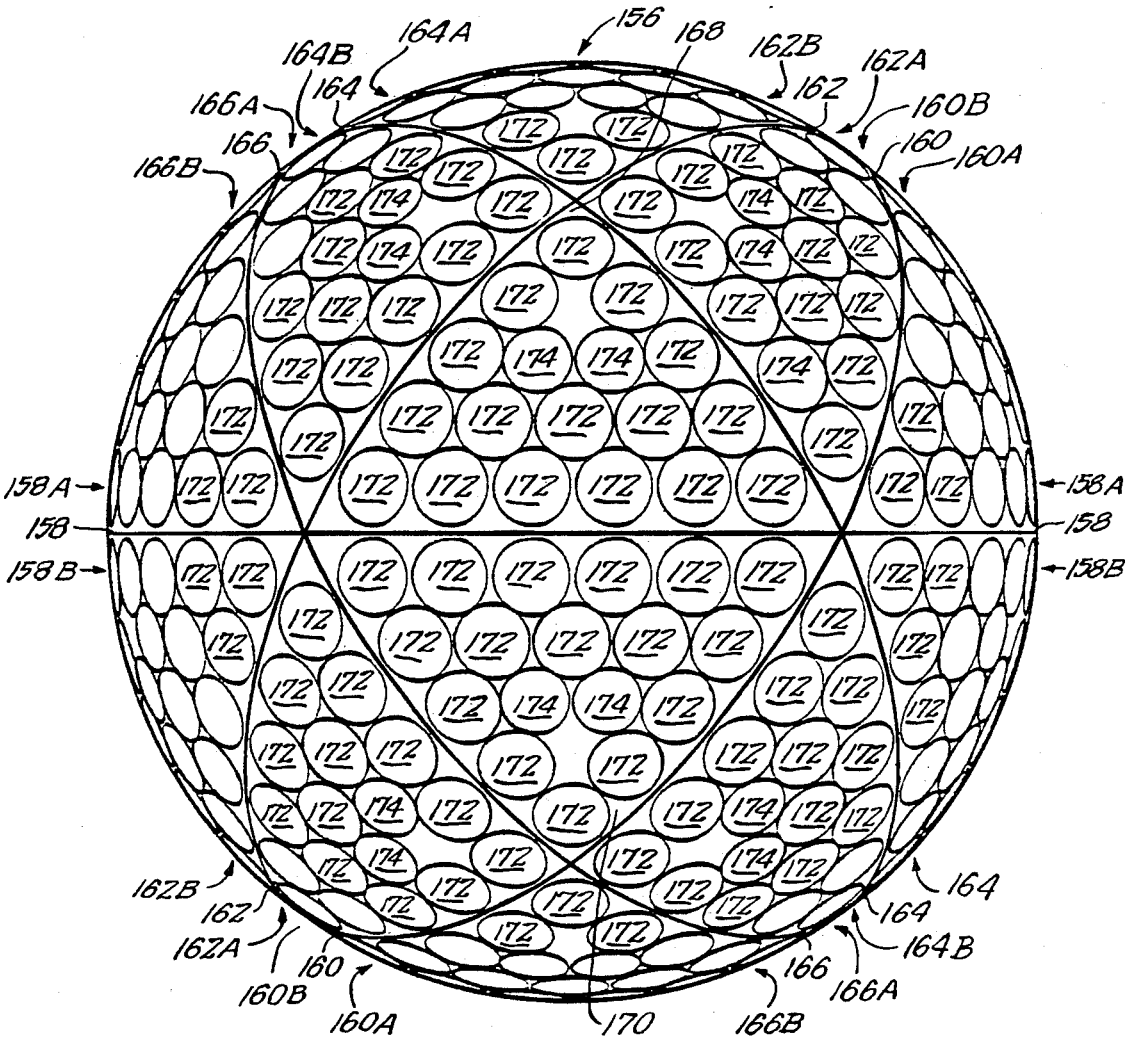

FIG. 14 illustrates yet another preferred embodiment of the present invention, wherein a projected view of golf ball 156 is made in accordance with the present invention having the dimple pattern of FIG. 7 laid thereon. Such a golf ball has 432 dimples thereon. In FIG. 14, golf ball 156 is illustrated having five great circular paths corresponding to the lines numbered 158, 160, 162, 164 and 166. Two isosceles triangles, 168 and 170, are shown. Both triangles 168 and 170 have dimples 172 which have a diameter of about 0.139 inches, and dimples 174 which have a diameter of about 0.125 inches. The pattern shown in FIG. 14 produces a golf ball with 432 dimples, 384 having a diameter of about 0.139 inches and 48 having a diameter of about 0.125 inches. The mirror image of the present invention is evident by comparing the dimples in rows 158A, 160A, 162A, 164A, and 166A with the dimples in rows 158B, 160B, 162B and 164B and 166B, respectively.

It is also readily apparent that the dimple pattern of triangle 168 is a substantial mirror image of the dimple pattern in triangle 170. Such a mirror image exists along each great circular path.

Figure 15:
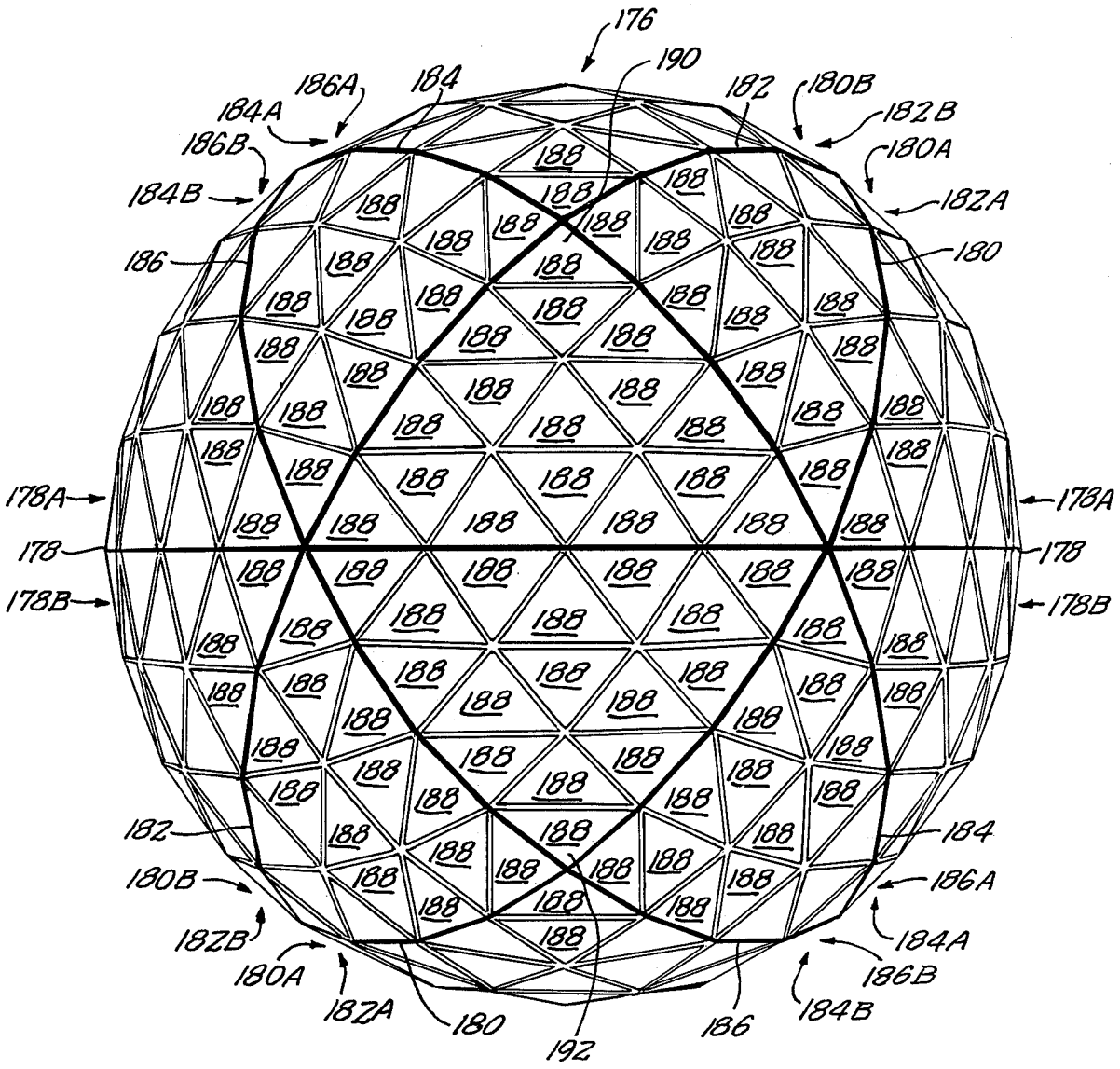

FIG. 15 illustrates yet another preferred embodiment of the present invention wherein a projected view of golf ball 176 is made in accordance with the present invention having the dimple pattern of FIG. 8 laid thereon. Such a golf ball has 384 triangular dimples thereon. In FIG. 15, golf ball 176 is illustrated with five great circular patterns, 178, 180, 182, 184 and 186. The mirror image dimple pattern of the present invention is evident by comparing the dimples in rows 178A, 180A, 182A, 184A and 186A with the dimples in rows 178B, 170B, 182B, 184B and 186B, respectively. Dimples 188 in this Figure are triangular, not circular as in FIGS. 2–14. The triangular dimples typically measure about 0.19 inches, about 0.21 inches, about 0.24 inches along the three sides and have a depth of about 0.013 inches. It is also readily apparent that the dimple pattern of isosceles triangle 190 is a mirror image of the dimple pattern of isosceles triangle 192. Such a mirror image exists along each of the great circular paths.

In FIGS. 9–15, the sixth great circular path is not evident because it is in the plane of the paper.

For any number appearing in the claims which is not modified by the term "about", it will be understood that the term "about" modifies such number.

A dimple, as used in the specification and claims and as used in the golf industry, is a standard term well known to those of skill in the art.

When referring to a dimple diameter, the term "diameter" as used herein means the diameter of a circle defined by the edges of the dimple. When the edges of a dimple are non-circular, the diameter means the diameter of a circle which has the same area as the area defined by the edges of the dimple. When the term "depth" is used herein, it is defined as the distance from the continuation of the periphery line of the surface of the golf ball to the deepest part of a dimple which is a section of a sphere. When the dimple is not a section of a sphere, the depth, in accordance with the present invention, is computed by taking a cross section of the dimple at its widest point. The area of the cross section is computed and then a section of a circle, of equal area, is substituted for the cross section. The depth is the distance from the continuation of the periphery line to the deepest part of the section of the circle.

It will be understood that the claims are intended to cover all changes and modifications of the preferred embodiment of the invention herein chosen for the purpose of illustration, which do not constitute a departure from the spirit and scope of the invention.

What is claimed is:

1. A golf ball having a spherical surface with a plurality of dimples formed thereon and six parting lines which do not intersect any dimple, the dimples being arranged by dividing the spherical surface into twenty-four spherical isosceles triangles, said twenty-four isosceles triangles being formed by inscribing a cube in said spherical surface and bisecting each face of said cube into four isosceles triangles, said six parting lines corresponding to six great circular paths formed along the bisecting lines of each square face of the cube, said dimples being arranged so that the dimples do not intersect the bisecting lines which form the six circular paths.

2. The golf ball of claim 1 wherein each isosceles triangle has a substantially similar dimple pattern.

3. The golf ball of claim 1 wherein the dimples are of two different sizes.

4. The golf ball of claim 1 wherein each isosceles triangle has the same number of dimples.

5. The golf ball of claim 1 wherein the total number of dimples is 360.

6. The golf ball of claim 1 wherein the total number of dimples is 384.

7. The golf ball of claim 1 wherein the total number of dimples is 408.

8. The golf ball of claim 1 wherein the total number of dimples is 432.

9. The golf ball of claim 1 wherein the total number of dimples is 384 and said dimples are triangular in shape.

10. A golf ball having a spherical surface with a plurality of dimples thereon and six great circular paths which do not intersect any dimples, the circular paths being arranged on the spherical surface by inscribing a cube in the spherical surface and bisecting each square face of said cube twice to form four isosceles triangles, said great circular paths corresponding to the bisecting line of each said square face, said dimples being arranged inside said isosceles triangle so that they do not intersect the bisecting lines.

11. The golf ball of claim 10 wherein each isosceles triangle has a substantially similar dimple pattern.

12. The golf ball of claim 10 wherein the dimples are of two different sizes.

13. The golf ball of claim 10 wherein each isosceles triangle has the same number of dimples.

14. The golf ball of claim 10 wherein the total number of dimples is 360.

15. The golf ball of claim 10 wherein the total number of dimples is 384.

16. The golf ball of claim 10 wherein the total number of dimples is 408.

17. The golf ball of claim 10 wherein the total number of dimples is 432.

18. The golf ball of claim 10 wherein the total number of dimples is 384 and said dimples are triangular in shape.

19. A golf ball having a spherical surface with a plurality of dimples thereon and six parting lines which do not intersect any dimples, said parting lines corresponding to circular paths which coextend with twelve bisecting lines, said bisecting lines corresponding to lines which bisect faces of a cube inscribed in said spherical surface, said lines forming four isosceles triangles from each face of said cube, said dimples being arranged so that they do not intersect the parting lines.

20. The golf ball of claim 18 wherein the total number of dimples is 384 and said dimples are triangular in shape.

* * * * *

UNITED STATES PATENT AND TRADEMARK OFFICE

CERTIFICATE OF CORRECTION

PATENT NO. : 4,772,026

DATED : September 20, 1988

INVENTOR(S) : William Gobush

It is certified that error appears in the above-identified patent and that said Letters Patent are hereby corrected as shown below:

Column 6, line 65, change the dependency from "claim 18" to --claim 19--.

Signed and Sealed this

Twenty-eighth Day of February, 1989

*Attest:*

DONALD J. QUIGG

*Attesting Officer*

*Commissioner of Patents and Trademarks*